US011795687B2

(12) United States Patent
Fontijn et al.

(10) Patent No.: US 11,795,687 B2
(45) Date of Patent: Oct. 24, 2023

(54) MINIMAL MULLION FAÇADE ASSEMBLY

(71) Applicant: GOLDBRECHT LLC, Culver City, CA (US)

(72) Inventors: Marcel Fontijn, Culver City, CA (US); Joshua Steven Ray, Los Angeles, CA (US)

(73) Assignee: GOLDBRECHT LLC, Culver City, CA (US)

( * ) Notice: Subject to any disclaimer, the term of this patent is extended or adjusted under 35 U.S.C. 154(b) by 449 days.

(21) Appl. No.: 16/592,140

(22) Filed: Oct. 3, 2019

(65) Prior Publication Data

US 2020/0109559 A1 Apr. 9, 2020

Related U.S. Application Data

(60) Provisional application No. 62/741,091, filed on Oct. 4, 2018.

(51) Int. Cl.

| | |
|---|---|
| ***E04B 2/90*** | (2006.01) |
| ***E06B 3/54*** | (2006.01) |
| *E04B 2/96* | (2006.01) |

(52) U.S. Cl.

CPC ..... *E04B 2/90* (2013.01); *E06B 3/5454* (2013.01); *E04B 2/967* (2013.01); *E06B 3/5427* (2013.01)

(58) Field of Classification Search

CPC ..... E04B 2/90; E04B 2/967; E06B 3/5454; E06B 3/5427

See application file for complete search history.

(56) References Cited

U.S. PATENT DOCUMENTS 2,976,970 A * 3/1961 Toney ..... E04B 2/967 52/235
3,057,444 A * 10/1962 Colon ..... E04B 2/96 52/459
3,071,215 A * 1/1963 Gall ..... E04B 2/96 52/456
3,176,806 A * 4/1965 Ferrell ..... E04B 2/962 52/282.4
3,182,766 A * 5/1965 Ferrell ..... E04B 2/965 52/579
3,218,768 A * 11/1965 Engholm ..... E04B 2/96 52/235
3,221,453 A * 12/1965 Lietaert ..... E04B 2/965 52/209
3,793,796 A * 2/1974 Hughes ..... E04B 1/3483 D25/4
3,844,087 A * 10/1974 Schultz ..... E04D 3/08 52/200
4,114,333 A * 9/1978 Jones ..... E04B 2/7411 52/265
4,128,983 A * 12/1978 Matsubara ..... E04B 1/615 52/238.1

(Continued)

FOREIGN PATENT DOCUMENTS

WO WO-2004089618 A1 * 10/2004 ..... B32B 17/10036

*Primary Examiner* — Phi D A

(74) *Attorney, Agent, or Firm* — Sughrue Mion, PLLC

(57) ABSTRACT

Provided is a curtain wall assembly including a first panel, and a second panel that is adjacent to the first panel. The curtain wall assembly includes a first attachment member attached to the first panel, and a second attachment member attached to the second panel. Each of the first attachment member and the second attachment member include at least one fin, and the first attachment member is secured to the second attachment member at the fin.

18 Claims, 4 Drawing Sheets

(56) References Cited

U.S. PATENT DOCUMENTS

| | | | | | |
|---|---|---|---|---|---|
| 4,481,747 | A * | 11/1984 | Tengesdal | F16B 5/0685 | 52/460 |
| 4,503,781 | A * | 3/1985 | Nilsson | A47B 57/18 | 108/64 |
| 4,658,559 | A * | 4/1987 | Doherty | A01G 9/1469 | 52/463 |
| 4,671,027 | A * | 6/1987 | Esposito | A01G 9/14 | 52/86 |
| 4,891,920 | A * | 1/1990 | Pingston | E04B 2/7409 | 181/287 |
| 4,998,395 | A * | 3/1991 | Bezner | E04F 13/18 | 52/563 |
| 5,040,347 | A * | 8/1991 | Valvis | E06B 3/68 | 52/204.591 |
| 5,228,254 | A * | 7/1993 | Honeycutt, Jr. | E04B 2/7407 | 52/241 |
| 5,617,684 | A * | 4/1997 | Sheath | E06B 3/99 | 52/235 |
| 6,405,504 | B1 * | 6/2002 | Richardson | E06B 1/36 | 52/211 |
| 6,962,025 | B1 * | 11/2005 | Hill | C23C 4/00 | 148/525 |
| 8,316,609 | B2 * | 11/2012 | Ben-Zvi | E04C 2/543 | 52/582.1 |
| 8,490,364 | B2 * | 7/2013 | Spransy | E04B 2/7453 | 52/772 |
| 8,955,270 | B2 * | 2/2015 | Markham | E06B 3/96 | 52/204.71 |
| 9,340,973 | B2 * | 5/2016 | Carbary | E04B 2/90 | |
| 10,917,980 | B2 * | 2/2021 | Andre | B29C 67/00 | |
| 2019/0271155 | A1 * | 9/2019 | Gilbertson | E04B 2/967 | |

* cited by examiner

MINIMAL MULLION FAÇADE ASSEMBLY

CROSS-REFERENCE TO RELATED APPLICATION(S)

This application claims is based on and claims priority under 35 U.S.C. § 119 to U.S. Application No. 62/741,091, filed on Oct. 4, 2018, in the U.S. Patent & Trademark Office, the disclosure of which is incorporated by reference herein in its entirety.

BACKGROUND

1. Field

Exemplary embodiments relate to doors and windows, and more particularly, to an assembly that provides a narrower front view section and improved thermal performance of the windows and doors.

2. Description of Related Art

Conventional methods and apparatuses for installing doors and windows use metal fasteners to attach glass through the façade.

Conventional apparatuses require the use of metal or similar conductive materials to travel from the exterior face of the glass to the interior face of the glass. Further, the fasteners are provided between the two panels, creating a large space. These conventional designs result in poor thermal performance and create a bulky look to the front view section of the façade.

Exemplary embodiments overcome these shortcomings and address the problems associated with the prior methods and apparatuses for installing side-by-side glass panels. The exemplary embodiments provide an assembly for attaching adjacent glass panels by removing fasteners going through a space between the two adjacent panels and eliminating metal or similar conductive materials from traveling from the exterior face of the glass to the interior face of the glass.

SUMMARY

According to an aspect of the disclosure, a curtain wall assembly may include a first panel, and a second panel that is adjacent to the first panel. The curtain wall assembly may include a first attachment member attached to the first panel, and a second attachment member attached to the second panel. Each of the first attachment member and the second attachment member include at least one fin, and the first attachment member is secured to the second attachment member at the fin.

BRIEF DESCRIPTION OF THE DRAWINGS

These and/or other aspects will become apparent and more readily appreciated from the following description of exemplary embodiments, taken in conjunction with the accompanying drawings of which.

DETAILED DESCRIPTION

Figure 1A:
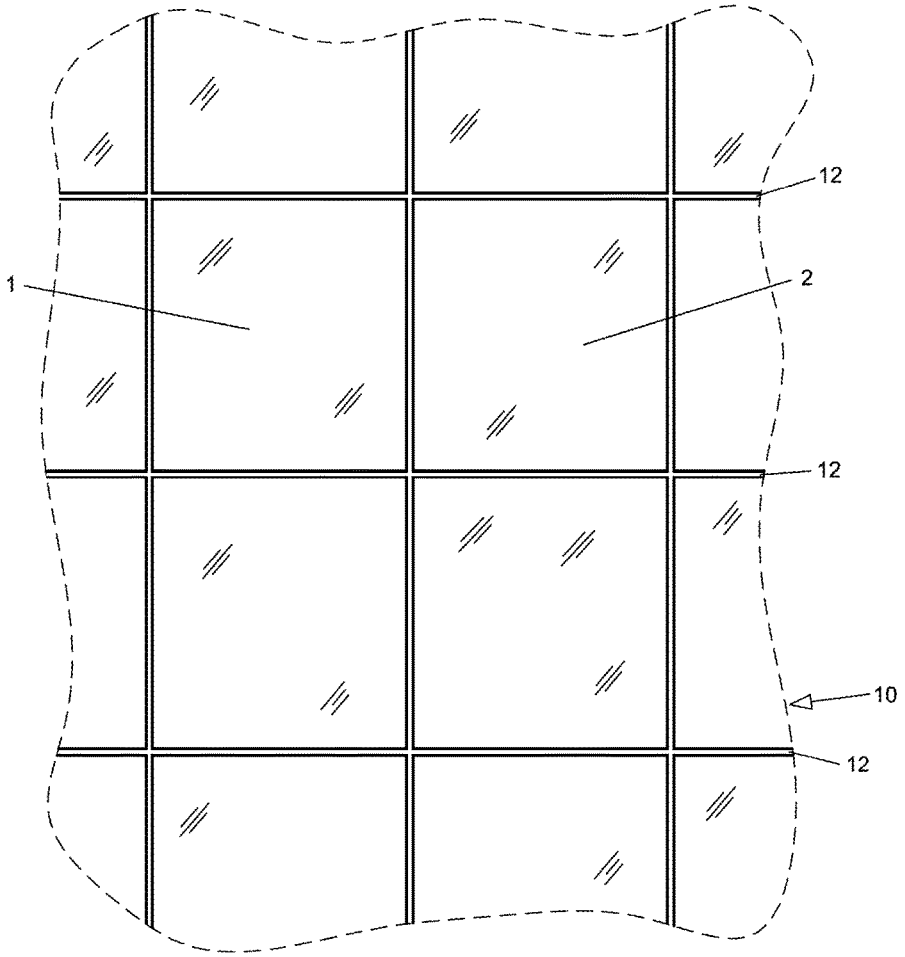
FIG. 1A is a diagram illustrating a front view of a plurality of panels according to an exemplary embodiment.
Figure 1B:
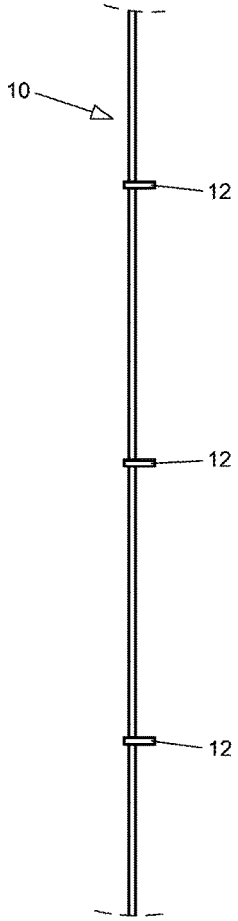
FIG. 1B is a diagram illustrating a side view of a plurality of panels according to an embodiment.
Figure 2A:
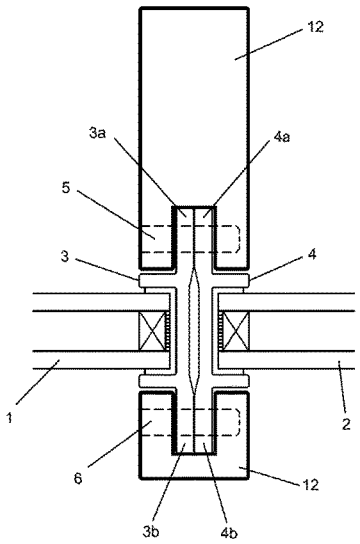
FIGS. 2A through 2C are views of an attachment mechanism for adjacent panels according to an exemplary embodiment.

FIG. 1A is a front view of a curtain wall assembly 10, and FIG. 1B is a side view of the curtain wall assembly 10. As shown in the drawings, with reference made to the reference numerals in FIGS. 1A and 1B, the curtain wall assembly 10 is provided with a first panel 1 adjacent to a second panel 2. According to an exemplary embodiment, each of the first panel 1 and the second panel 2 is formed of glass. However, as will be understood by one of ordinary skill in the art, the first panel 1 and the second panel 2 can be formed of any material suitable for windows and/or transparent or semi-transparent portions of doors. As further shown in FIGS. 1A and 1B, a frame 12 is configured to support the panel 1 and the panel 2. As shown in FIG. 2A, the attachment mechanism for attaching the adjacent first panel 1 to the second panel 2 is illustrated. According to an exemplary embodiment, a first attachment member 3 is connected to the first panel and a second attachment member 4 is connected to the second panel 2. It will be understood that any method known to one of ordinary skill in the art can be used to connect the first attachment member 3 and the second attachment member 4 to the first panel 1 and the second panel 2, respectively. However, in order to improve the thermal performance of windows and doors, no metal is provided between the panels and the attachment members in an embodiment. Further, according to an exemplary embodiment, the first attachment member 3 and the second attachment member 4 can be made of any suitable rigid material of reduced thermal conductivity.

Each of the first attachment member 3 and the second attachment member 4 is provided with at least one fin 3*a* and 4*a*, respectively. Each fin 3*a*, 4*a* protrudes from the respective attachment member in a direction perpendicular to the first panel 1 and the second panel 2. Further, each fin 3*a* and 4*a* extends into a recess formed in the frame 12. The fin 3*a* may be integrated to first attachment member 3, and the fin 4*a* may be integrated to the second attachment member 4. In this case, the fin 3*a* and the fin 4*a* may be formed of the same material as the first attachment member 3 and the second attachment member 4, respectively. Alternatively, in other implementations, the fin 3*a* and the fin 4*a* may be formed separately from the first attachment member 3 and the second attachment member 4, and/or may be formed of different materials than the first attachment member 3 and the second attachment member 4.

While not shown, fin 3*a* and fin 4*a* are each provided with a through opening. A capture device 5 is provided through the opening of fins 3*a* and 4*a*, and attaches the first attachment member 3 to the second attachment member 4. Further, the capture device 5 attaches the first attachment member 3 and the second attachment member 4 to the frame 12. According to a non-limiting exemplary embodiment, when attached together, the thickness of the first attachment member 3 and the second attachment member 4 in the horizontal direction (e.g., shown as left to right in FIG. 2A) is preferably equal to or less than 1.25 inches. It will be understood that the thickness is not limited to this exemplary embodiment. In this manner, the first panel 1 and the second panel 2 are attached adjacent to each other to reduce the space, thereby improving the front view of the façade.

As shown in FIG. 2A, the first attachment member 3 and the second attachment member 4 can be substantially U-shaped, but are not limited to this shape. According to an exemplary embodiment, this shape allows the attachment member 3 and the attachment member 4 to contact three sides of the panel 1 and the panel 2 and increase the strength of the connection.

Figure 2B:
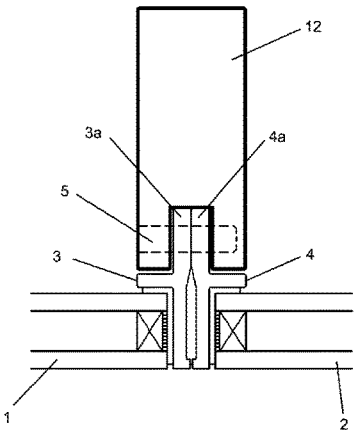

As shown in FIG. 2B, and according to another example embodiment, the first attachment member 3 and the second attachment member 4 can be substantially L-shaped. In this way, the L-shape permits the first attachment member 3 and the second attachment member 4 to contact two sides of the panels 1 or 2, respectively. Further in this case, the first attachment member 3 and the second attachment member 4 connect to a single portion of the frame 12, instead of multiple portions of the frame 12 as shown in FIGS. 2A and 2C.

As shown in FIG. 2A, and according to yet another exemplary embodiment, the first attachment member 3 and the second attachment member 4 may each include a second fin 3*b*, 4*b* opposite the first fins 3*a*, 4*a*. The second fin 3*b* and the second fin 4*b* may extend into a recess formed in the frame 12. The second fins 3*b*, 4*b* can each include a through hole and are attached together by an additional capture device 6, thereby improving the connection between the panels. The additional capture device 6 may attach the first attachment member 3 and the second attachment member 4 to the frame 12.

Figure 2C:
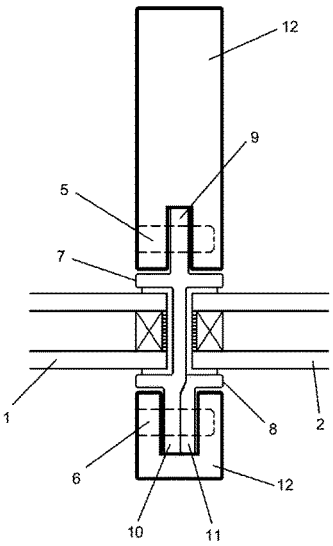

As shown in FIG. 2C, the first attachment member 3 and the second attachment member 4 may be integrated to form an integrated attachment member 7. The integrated attachment member 7 may include an integrated fin 9, and a second fin 10. Further, a second attachment member 8 with a third fin 11 may be provided so as to correspond to the second fin 10.

The integrated fin 9 may extend into a recess formed in the frame 12. As shown, a capture device 5 is provided through an opening of the integrated fin 9 of the integrated attachment member 7 to anchor the integrated fin 9 and the integrated attachment member 7 to the frame 12. As further shown, an additional capture device 6 is provided through openings of the second fin 10 and the third fin 11 to anchor the second fin 10 and the third fin 11 to the frame 12. The capture device 5 and/or the additional capture device 6 may be formed of any suitable material, such as metal, a plastic, a composite, and/or the like.

As will be understood by one of ordinary skill in the art, the attachment members may be provided between any two adjacent panels. This arrangement provides strength to the panel assembly, while simultaneously improving the thermal properties and the façade of the panels.

According to an exemplary embodiment, and as shown in FIGS. 3A, 3B, 4A, and 4B, the second panel 2 of curtain wall assembly 10 is configured to move with respect to the first panel 1. The movement is facilitated by a side of the second panel 2 opposite the first attachment member 3 rotating away from the plane in which the first panel 1 is disposed using a hinge 15. The hinge 15 may be connected to the first attachment member 3 and the second attachment member 4 and allows the first attachment member 3 to move with respect to the second attachment member 4.

Figure 3A:
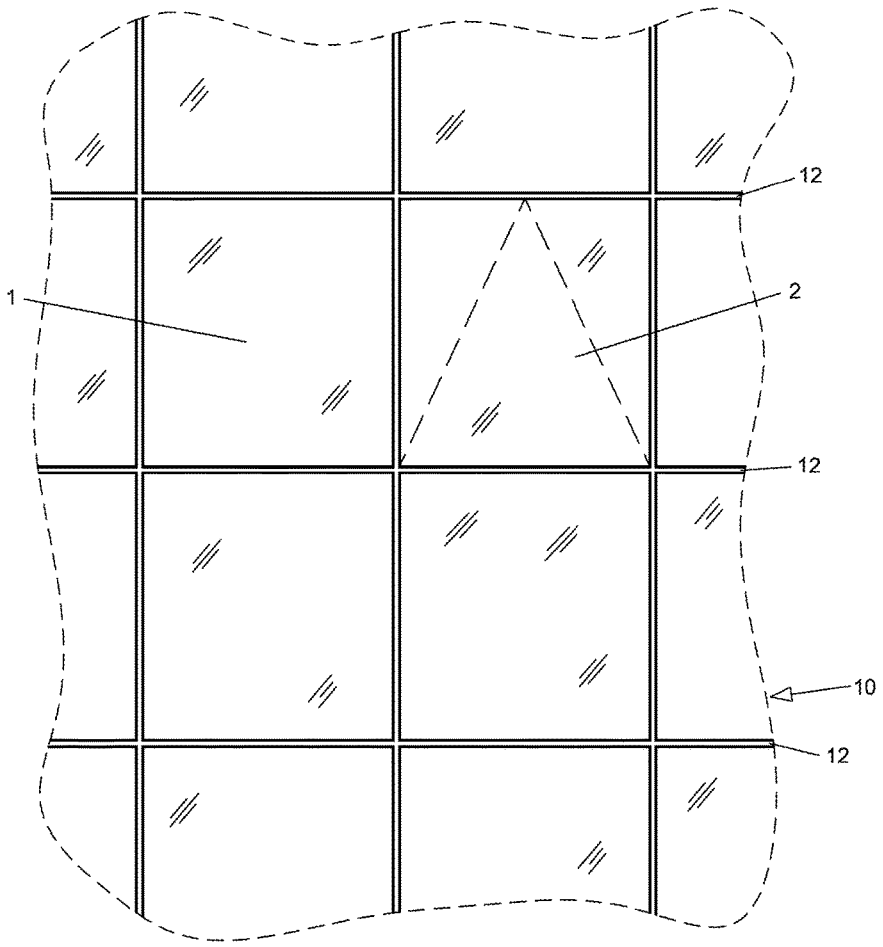
FIG. 3A is a diagram illustrating a front view of an operable system having an integrated hinge for an awning or casement according to another exemplary embodiment, in which the awning or the casement is in a closed position.
Figure 3B:
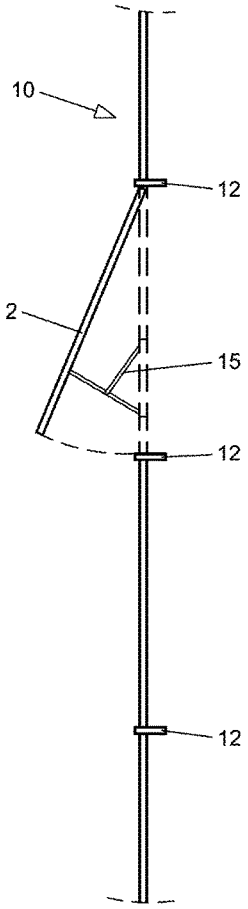
FIG. 3B is a diagram illustrating a side view of an operable system having an integrated hinge for an awning or casement according to another exemplary embodiment, in which the awning or the casement is in an open position.

As shown in FIG. 3B, the second panel 2 may move with respect to the first panel 1 via the hinge 15. Specifically, the second panel 2 connected to the hinge 15 may rotate with respect to the first panel 1 connected to hinge 15. The hinge 15 may extend vertically and/or horizontally.

Figure 4A:
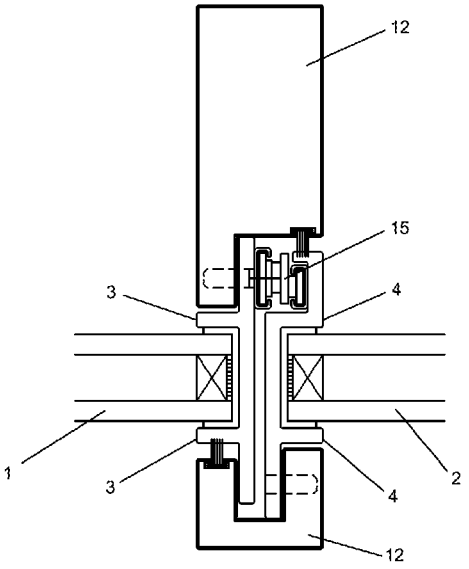
FIG. 4A is a diagram illustrating an operable system having an integrated hinge for an awning or casement according to another exemplary embodiment, in which the awning or casement is in a closed position.

As shown in FIG. 4A, the hinge 15 may be attached to the first attachment member 3 and the second attachment member 4. As shown, the first attachment member 3 may be attached to a first frame portion 12 (shown at the top of the page), and may be removably connected to a second frame portion 12 (shown at the bottom of the page). Further, the second attachment member 4 may be removably connected to the first frame portion 12 and the first attachment member 3 via the hinge 15. As further shown, the second attachment member 4 may be connected to the second frame portion 12.

Figure 4B:
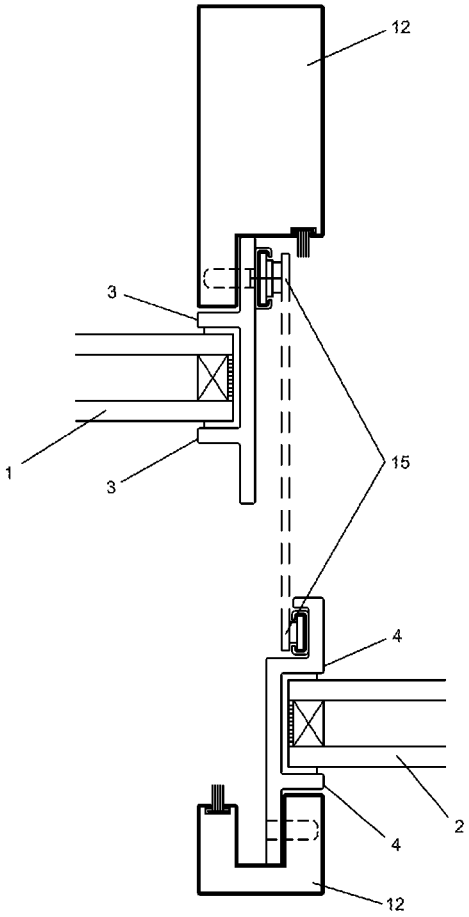
FIG. 4B illustrates an operable system having an integrated hinge for an awning or casement according to another exemplary embodiment, in which the awning or casement is in an open position.

As shown in FIG. 4B, the second attachment member 4 may be removably disconnected from the first attachment member 3 via the hinge 15. That is, the second attachment member 4 may rotate with respect to the hinge 15, and rotate outwardly with respect to the first panel 1.

What is claimed is:

1. A curtain wall assembly, comprising:

a first panel;

a second panel, adjacent to the first panel;

a first attachment member attached to the first panel; and a second attachment member attached to the second panel, wherein the first panel and the second panel are glass, wherein the first attachment member comprises a first fin and the second attachment member comprises a second fin, and the first attachment member is secured to the second attachment member at the first fin and the second fin by receiving a metal capture device extended through a frame and portions of the first fin and the second fin each protruding, into a cavity of the frame, outwardly from a space between the first panel and the second panel, wherein, in an assembled position, no metal is provided between the first panel and the second panel.

2. The curtain wall assembly of claim 1, wherein the first attachment member is bonded to the first panel, and the second attachment member is bonded to the second panel.

3. The curtain wall assembly of claim 1, wherein the first fin and the second fin are provided with through openings at the portions, and the first attachment member is secured to the second attachment member by the metal capture device provided in the through openings.

4. The curtain wall assembly of claim 3, wherein the capture device is parallel to the first panel and the second panel.

5. The curtain wall assembly of claim 1, wherein the first attachment member and the second attachment member are each formed of a rigid material of reduced thermal conductivity.

6. The curtain wall assembly of claim 1, wherein a thickness of the first attachment member in a direction parallel to the first panel and a thickness of the second attachment member in the direction parallel to the first panel is equal to or less than 1.25 inches.

7. The curtain wall assembly of claim 1, wherein the first attachment member includes a U-shaped channel and the first attachment member contacts at least three sides of the first panel when attached to the first panel.

8. The curtain wall assembly of claim 1, wherein the first attachment member includes a L-shaped channel and the first attachment member contacts at least two sides of the first panel when attached to the first panel.

9. The curtain wall assembly of claim 1, wherein the second attachment member includes a U-shaped channel and the second attachment member contacts at least three sides of the second panel when attached to the second panel.

10. The curtain wall assembly of claim 1, wherein the second attachment member includes a L-shaped channel and the second attachment member contacts at least two sides of the second panel when attached to the second panel.

11. The curtain wall assembly of claim 3, wherein the first attachment member comprises a third fin opposite to the first fin and the second attachment member comprises a fourth fin opposite to the second fin, the third fin is provided with a third through opening and the fourth fin is provided with a fourth through opening, and an additional capture device is provided through the third through opening and the fourth through opening to attach the third fin and the fourth fin together.

12. The curtain wall assembly of claim 1, wherein the first attachment member includes a third fin in addition to the first fin, wherein the second attachment member includes a fourth fin in addition to the second fin, and wherein the first attachment member and the second attachment member are attached via the third fin and the fourth fin.

13. The curtain wall assembly according to claim 1, wherein the first panel is configured to move with respect to the second panel.

14. The curtain wall assembly according to claim 10, wherein a side of the first panel opposite the first attachment member rotates away from the plane in which the second panel is disposed.

15. The curtain wall assembly according to claim 11, wherein a hinge is connected to the first attachment member and the second attachment member and allows the first attachment member to move with respect to the second attachment member.

16. The curtain wall assembly according to claim 1, wherein each of the first fin and the second fin are in contact with other and protrude from extensions of the first attachment member and the second attachment member, and wherein the extensions are extended into the space between the first panel and the second panel.

17. A curtain wall assembly, comprising:

a first panel;

a second panel, adjacent to the first panel;

a first attachment member attached to the first panel; and a second attachment member attached to the second panel, wherein the first panel and the second panel are glass, wherein the first attachment member comprises a first fin and the second attachment member comprises a second fin, and the first attachment member is secured to the second attachment member at the first fin and the second fin by receiving a metal capture device extended through a frame and portions of the first fin and the second fin each protruding, into a cavity of the frame, outwardly from a space between the first panel and the second panel, wherein the first attachment member includes a U-shaped channel and the first attachment member contacts at least three sides of the first panel when attached to the first panel.

18. A curtain wall assembly, comprising:

a first panel;

a second panel, adjacent to the first panel;

a first attachment member attached to the first panel; and a second attachment member attached to the second panel, wherein the first panel and the second panel are glass, wherein the first attachment member comprises a first fin and the second attachment member comprises a second fin, and the first attachment member is secured to the second attachment member at the first fin and the second fin by receiving a metal capture device extended through a frame and portions of the first fin and the second fin each protruding, into a cavity of the frame, outwardly from a space between the first panel and the second panel, wherein the first fin and the second fin are provided with through openings at the portions, the first attachment member is secured to the second attachment member by the metal capture device provided in the through openings, the first attachment member comprises a third fin opposite to the first fin and the second attachment member comprises a fourth fin opposite to the second fin, the third fin is provided with a third through opening and the fourth fin is provided with a fourth through opening, and an additional capture device is provided through the third through opening and the fourth through opening to attach the third fin and the fourth fin together.

* * * * *